US005669659A

United States Patent [19]

Dittmer

[11] Patent Number: 5,669,659

[45] Date of Patent: Sep. 23, 1997

[54] COMBINATION CHAIR AND HAND TRUCK

[76] Inventor: Thomas E. Dittmer, 317 Peru-Olena Rd., Norwalk, Ohio 44857

[21] Appl. No.: 700,276

[22] Filed: Aug. 20, 1996

[51] Int. Cl.[6] ..... A47C 13/00

[52] U.S. Cl. ..... 297/129; 297/440.1; 280/30; 280/47.18

[58] Field of Search ..... 280/30, 47.18, 280/47.19, 47.21; 297/129, 118, 55, 440.1, 423.4, 440.24; 29/428

[56] References Cited

U.S. PATENT DOCUMENTS

| | | | |
|---|---|---|---|
| 327,105 | 9/1885 | Pierce | 297/55 |
| 867,754 | 10/1907 | Randall | 280/30 |
| 1,725,095 | 8/1929 | Morrow | 280/47.21 X |
| 2,694,442 | 11/1954 | Nordmark | 297/55 |
| 2,957,700 | 10/1960 | Beaurline | 280/47.19 |
| 3,041,084 | 6/1962 | Stehman et al. | 280/47.24 |
| 3,116,936 | 1/1964 | Magarium | 280/47.19 |
| 3,997,213 | 12/1976 | Smith et al. | 297/118 |
| 4,429,897 | 2/1984 | Friedman et al. | 280/646 |
| 4,460,188 | 7/1984 | Maloof | 280/30 |
| 4,494,626 | 1/1985 | Ast | 280/30 X |
| 4,533,151 | 8/1985 | Maitland | 280/47.25 |
| 4,561,674 | 12/1985 | Alessio | 280/47.21 X |
| 4,645,262 | 2/1987 | Furubotten | 280/47.21 X |
| 4,703,944 | 11/1987 | Higson | 280/30 |
| 4,733,905 | 3/1988 | Buickerood et al. | 297/129 |
| 4,824,167 | 4/1989 | King | 297/129 |
| 4,934,718 | 6/1990 | Voegele | 280/30 |
| 4,934,719 | 6/1990 | du Pont | 280/30 X |
| 5,062,650 | 11/1991 | Chang | 297/129 |
| 5,161,811 | 11/1992 | Cheng | 280/30 |
| 5,213,360 | 5/1993 | Lin | 280/648 |
| 5,306,027 | 4/1994 | Cheng | 280/30 |
| 5,356,197 | 10/1994 | Simic | 297/129 |
| 5,362,079 | 11/1994 | Graham | 280/47.23 |
| 5,364,112 | 11/1994 | Jackson | 280/30 |
| 5,492,347 | 2/1996 | Palmeri et al. | 280/30 X |

FOREIGN PATENT DOCUMENTS

| | | | |
|---|---|---|---|
| 4233398 | 4/1994 | Germany | 297/129 |

*Primary Examiner*—Milton Nelson, Jr.
*Attorney, Agent, or Firm*—Brinks Hofer Gilson & Lione

[57] ABSTRACT

A platform assembly and wheel assembly for retrofitting a folding chair to form a combination chair and hand truck. The platform assembly is removably attached to the bottom section of the pair of leg members forming the front legs of the folding chair. Similarly, the wheel assembly is removably attached to the bottom section of the pair of load support members forming the back legs of the folding chair. The wheel assembly includes a plurality of brackets for removably attaching the wheel assembly to the pair of upright support members, an axle fixedly attached to the plurality of brackets, and a pair of wheels rotatably connected to opposite ends of the axle. The platform assembly includes a lift member, a transverse platform and a plurality of elongated right and left channels extending vertically from the lift member or clamps for removably attaching the platform assembly to the front legs of the folding chair. When the combination chair and hand truck is folded in an open position, it will function as a chair. When the combination chair and hand truck is folded in a closed position, it will function as a hand truck.

15 Claims, 4 Drawing Sheets

COMBINATION CHAIR AND HAND TRUCK

BACKGROUND OF THE INVENTION

1. Field of the Invention

The invention relates to a combination chair and hand truck, and in particular, to a method and apparatus for retrofitting a conventional folding chair into a combination chair and hand truck.

2. Related Art

A variety of combination dollies and carts are available that are useful for many purposes. For example, U.S. Pat. No. 4,824,167 to King discloses a multipurpose chair structure that functions as a chair when unfolded and as a luggage carrier when folded. The structure includes a pair of U-shape frame members pivotally secured together for folding and unfolding of the device.

However, the multipurpose chair structure of King is specifically designed and does not disclose, teach or suggest retrofitting a conventional folding chair into a combination folding chair and hand truck.

SUMMARY OF THE INVENTION

Accordingly, an object of the invention is to provide a method and apparatus for retrofitting a conventional folding chair into a combination folding chair and hand truck requiring minor or no modifications to the folding chair. Another object of the invention is to provide a combination folding chair and hand truck that can be provided in kit form and easily retrofitted to an existing folding chair, for example, a lawn chair, without significantly compromising the ability to fold the combination chair and hand truck in an open and closed position. Yet another object of the invention is to provide a lightweight and inexpensive device which can be utilized as both a cargo carrying device and as a chair.

To achieve these and other objects, the invention provides a combination chair and hand truck arrangement that can be expanded to form a chair and can be folded or collapsed into a generally planar configuration to form a cargo-carrying hand truck. This is accomplished by retrofitting a commercially available folding chair made of a rigid structural material, preferably metal material, with a wheel assembly and a platform assembly such that when the combination chair and hand truck is folded up into its storage or closed position, the combination chair and hand truck will function as a hand truck, and when it is folded down into its out or open position, the combination chair and hand truck will function as a folding chair.

According to a preferred embodiment of the invention, a folding chair includes a pair of upright members held in a parallel spaced relationship.

A wheel assembly is fixedly attached to the upright members. The wheel assembly includes a plurality of brackets for attaching the wheel assembly to the load support members. The brackets extend outwardly toward the rear of the combination folding chair and hand truck. An axle passes through the brackets and extends beyond the load support members of the chair. Wheels are rotatably connected to opposite ends of the axle. The wheels extend above the ground when the combination chair and hand truck is folded in the open position to be used as a chair and contact the ground when the combination chair and hand truck is folded in the closed position and tilted rearwardly towards the user person to be used as a hand truck. The wheel assembly is preferably made of metal material similar to the metal material used in manufacturing the chair.

A platform assembly is fixedly attached adjacent the lower region of the two front legs of the folding chair. The platform assembly comprises a lift member supported by a transverse platform substantially perpendicular to the lift member and extending vertically upward therefrom. A pair of elongated right and left channels secures the platform assembly to the front legs of the folding chair.

To use the invention as a hand truck, the combination chair and hand truck is folded into its closed position providing a cargo-carrying area along the platform assembly, seat, and back rest. In this position, the combination chair and hand truck is capable of supporting a load that is desired to be carried. To tow the cargo load upon the wheels, the person user pivots the combination chair and hand truck rearwardly towards the user person.

To use the invention as a chair, the cargo load is unloaded and the combination chair and hand truck is unfolded into its open position. The platform assembly can be either removed or left in place to be used as a foot rest. Both the wheel assembly and platform are secured to the folding chair without significantly compromising the ability to fold the combination chair and hand truck in the open or closed position.

These and other aspects and advantages of the invention are described or apparent from the following detailed description of the preferred embodiments and appended drawings wherein like reference numbers refer to the same element, feature or component.

BRIEF DESCRIPTION OF THE DRAWINGS

The preferred embodiments are described with reference to the drawings in which.

DETAILED DESCRIPTION OF THE PREFERRED EMBODIMENTS

Figure 1:
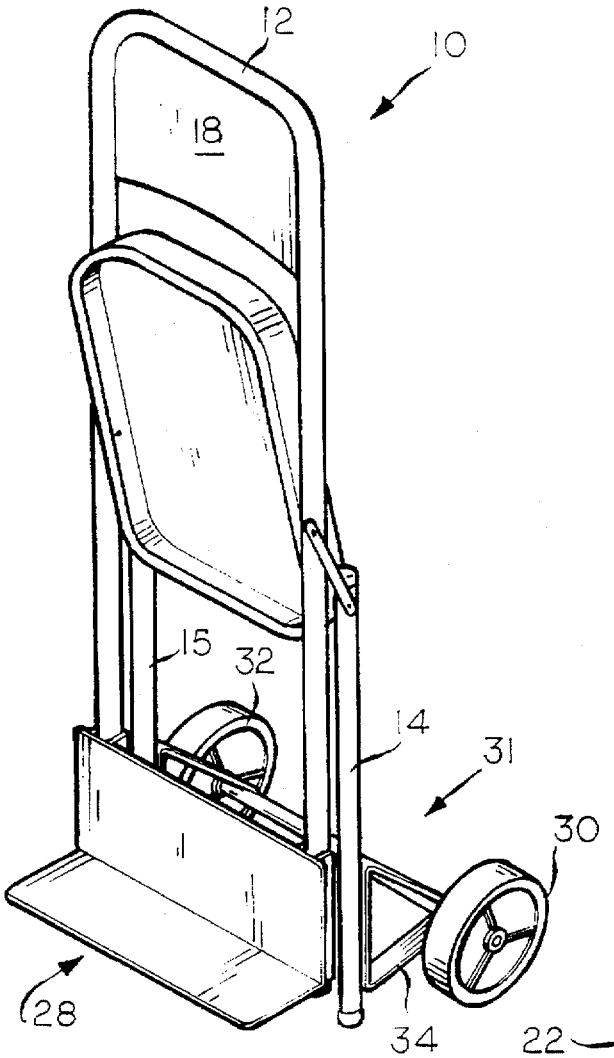
FIG. 1 is an isometric view of a combination chair and hand truck in the closed position in accordance with the invention.

Referring to the drawings, wherein like reference characters represent like elements, FIGS. 1–8 show a combination chair and hand truck in accordance with the invention. The combination chair and hand truck, generally identified by reference numeral 10, is constructed as a dual purpose utilitarian structure that may be used to carry a load when in the closed position and may be used as a chair when in the open position.

Figure 2:
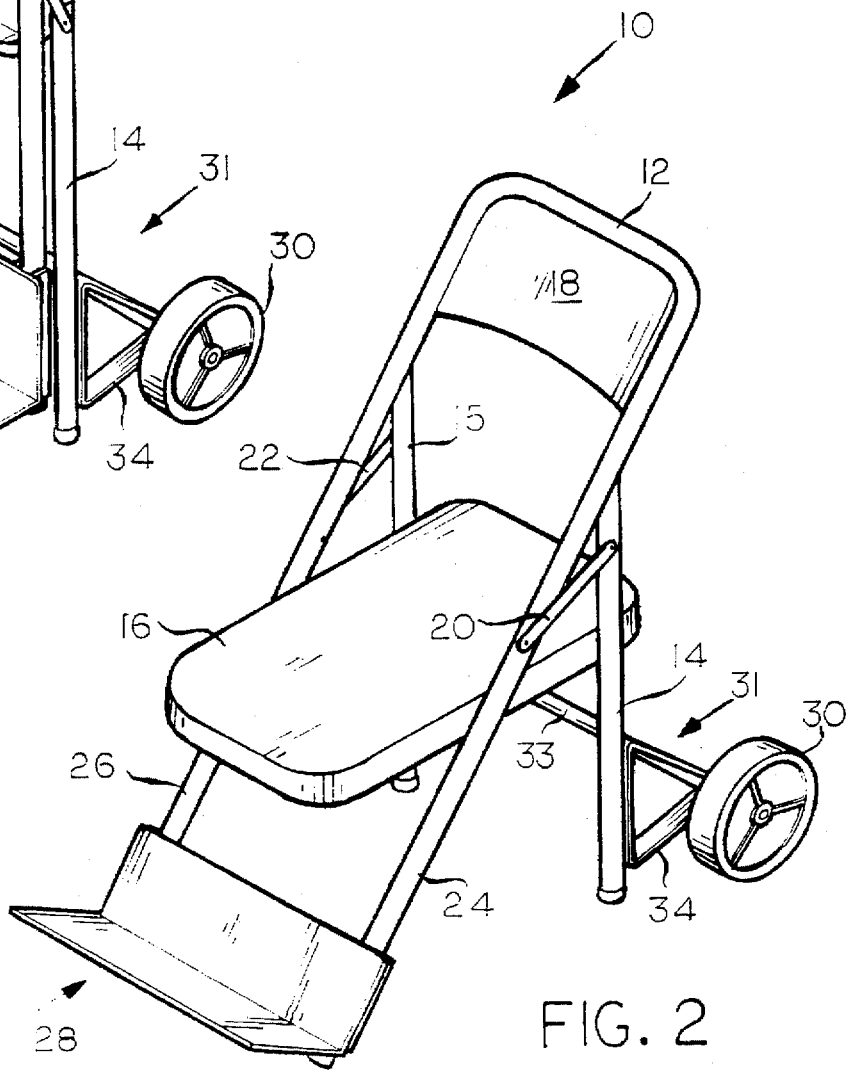
FIG. 2 is an isometric view of the combination chair and hand truck of FIG. 1 in the open position.

In a preferred embodiment, the combination chair and hand truck 10 comprises load support members 14, 15 and a u-shaped carrying frame 12 which terminate in a pair of leg members 24, 26. Support members 14, 15, and leg members 24, 26 are pivotally interconnected with seat 16 and with links 20 and 22 as shown in FIG. 2. Carrying frame 12 provides an arcuate back rest 18 to present a concavity adapting the contour of the back of the user person.

The structure and interconnection of the combination chair and hand truck 10 is otherwise conventional and accordingly it will not be further described. In particular, the framework and fixation of the carrying frame 12, support members 14, 15, seat 16, and back rest 18 can be carried out in a plurality of different ways known to those skilled in the art. The invention is obviously not limited to the type of such structure and fixation.

Figure 5:
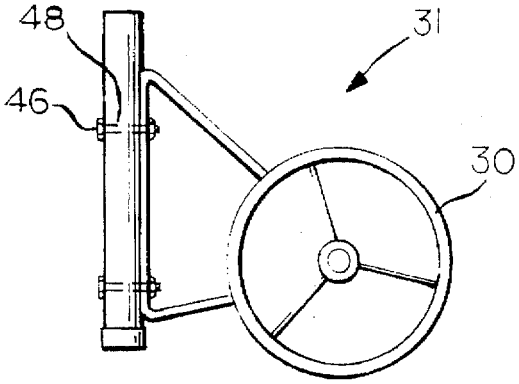
FIG. 5 is a side view of the wheel assembly of FIG. 3.
Figure 4:
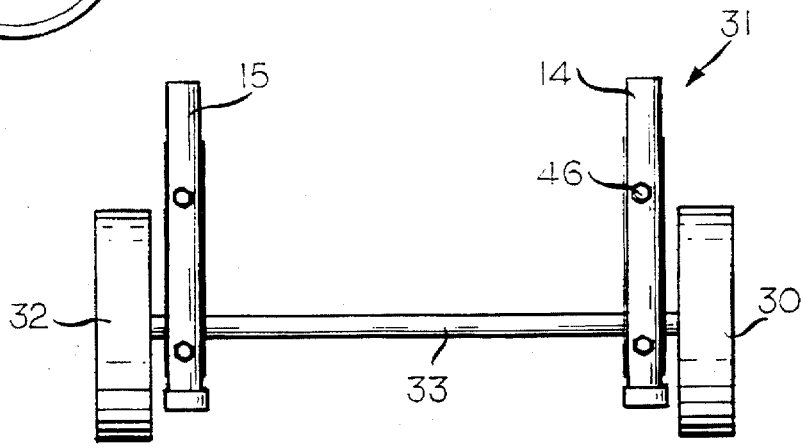
FIG. 4 is a front view of the wheel assembly of FIG. 3.
Figure 3:
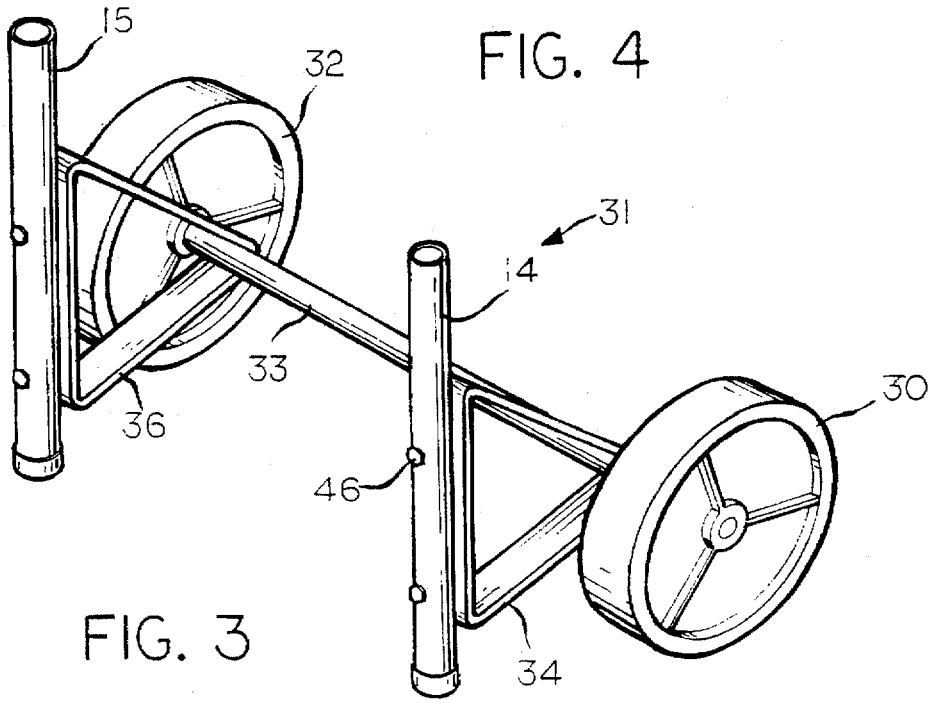
FIG. 3 is a partial isometric view of the wheel assembly of the combination chair and hand truck of FIG. 1.
Figure 8:
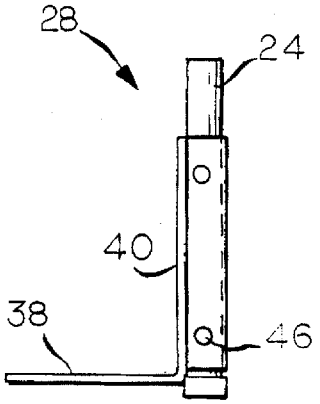
FIG. 8 is a side view of the platform assembly of FIG. 6.

As shown in FIGS. 3–5, a wheel assembly 31 includes a pair of wheels 30 and 32 carried at the opposite ends of an axle 33 which in turn is supported by brackets 34 and 36 of a triangular design. Brackets 34 and 36 are rigidly connected adjacent the ends of rear legs 14 and 15 and extend toward the rear of the chair for engaging with the floor when the chair is tilted rearwardly to be used as a dolly. Brackets 34 and 36 is also provided with a pair of apertures 48 for permitting each brackets 34 and 36 to be secured to rear legs 14 and 15 by inserting threaded bolt or screw 46 through openings in rear legs 14 and 15.

Wheel assembly 31 is shown in a double wheel configuration, but single wheels or other mobile supporting apparatus may be used. The double wheel configuration provides the advantage of stability and tracking when the chair and hand truck 10 is used as a dolly. Furthermore, as is apparent in FIG. 5, when the chair is folded, wheel assembly 31 may be attached along legs 14 and 15 so as to rest upon the ground to provide a means for stopping and holding the combination chair and hand truck 10 in a stationary generally upright position relative to the ground (FIG. 1).

Adjacent the lower end of leg members 24 and 26, the combination chair and hand truck 10 includes a lifting platform assembly 28. The details of the platform assembly 28 is best seen in connection with FIGS. 6, 7 and 8.

The platform assembly 28 comprises a lift member 38 having a generally rectangular shape. This lift member 38 is fixed to and supported by a transverse platform 40. The transverse platform 40 is likewise rectangular in shape and is substantially perpendicular to lift member 38 and extends vertically upwardly therefrom.

Figure 7:
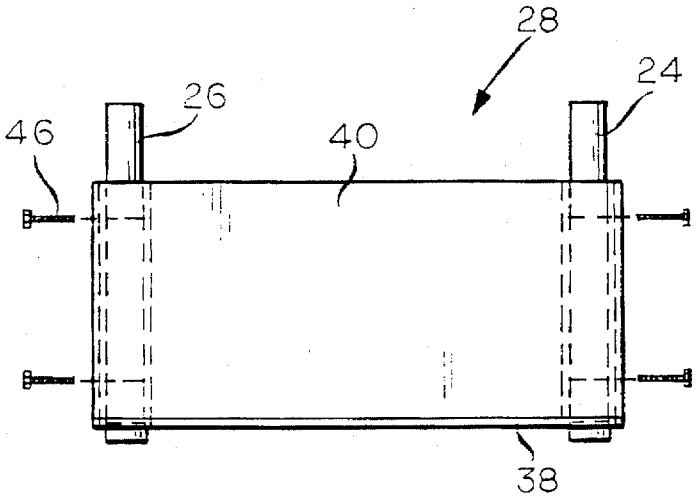
FIG. 7 is an exploded front view of the platform assembly of FIG. 6.
Figure 6:
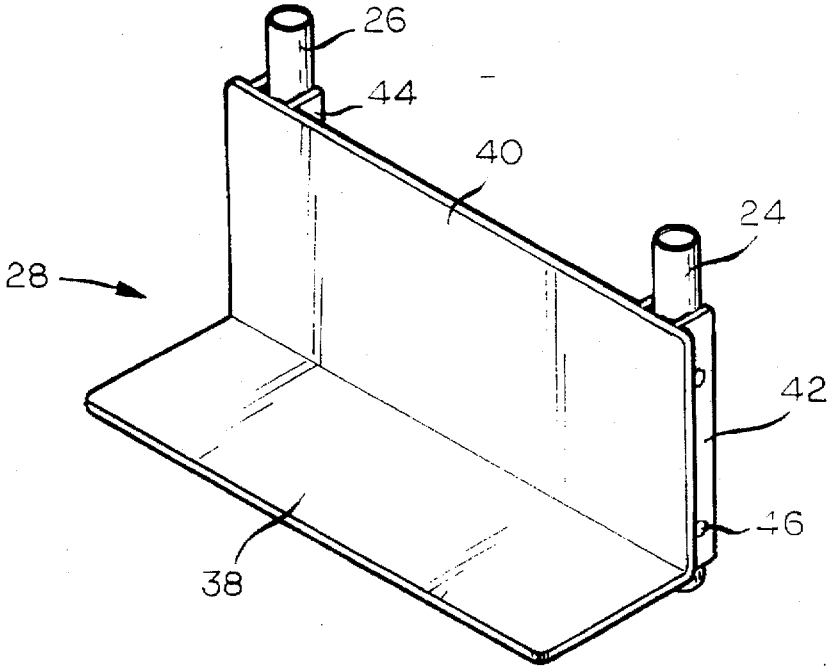
FIG. 6 is a partial isometric view of the platform assembly of the combination chair and hand truck of FIG. 1.

Along its inner side, opposite lift member 38, transverse platform 40 is provided with a pair of elongated right and left channels 42 and 44. As best seen in FIG. 7, platform assembly 28 includes elongated channels 42 and 44 for securing assembly 28 to the lower ends of leg members 24 and 26. Channels 42 and 44 is provided with apertures drilled transversely through it, and a long, threaded bolt or screw 46 is inserted through the hole. The threaded bolt 46 passes through openings in leg members 24 and 26 and is tightened with a cooperating nut (not shown) into a tight friction fit with the inside surface of the leg members 24 and 26.

Figure 9:
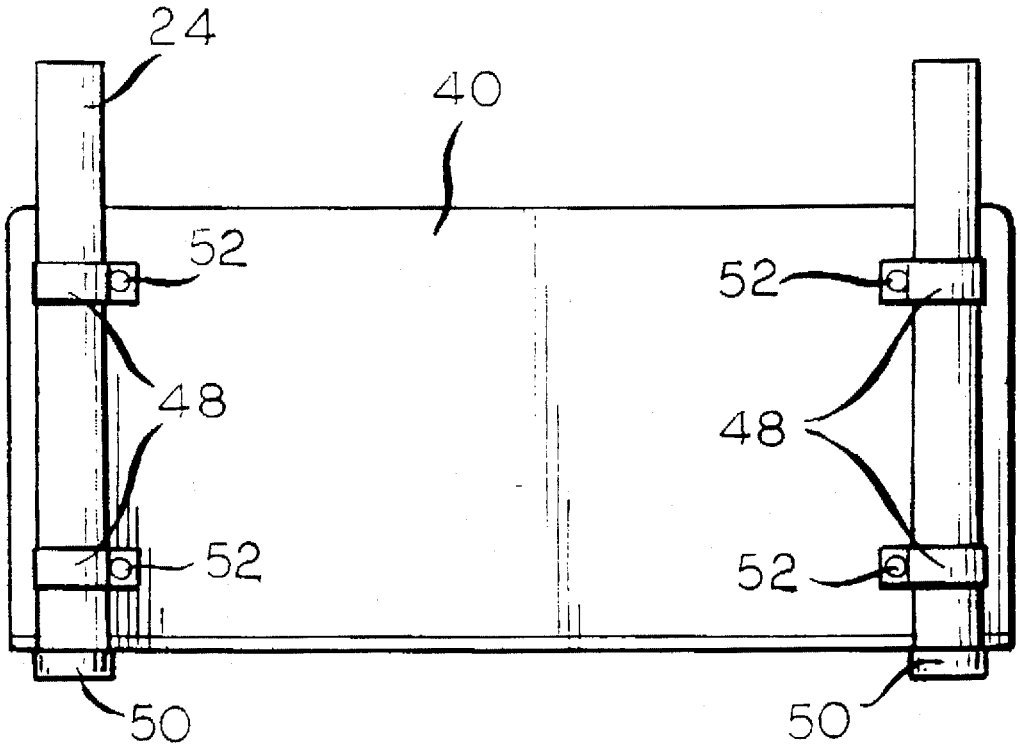
FIG. 9 is a side view of an alternative embodiment for attaching the platform assembly of the combination chair and hand truck of FIG. 1.

FIG. 9 illustrates an alternative embodiment for attaching tranverse platform 40 of platform assembly 28 to leg members 24 and 26. In the alternative embodiment, transverse platform 40 is attached to leg members 24 and 26 using clamps 48, preferably commercially available metal electrical conduit clamps. In addition, leg members 24 and 26 may include a cap 50 for covering the ends of leg members 24 and 26 and for providing stability to hand truck 10 when in an vertical storage or closed position (FIG. 1). Metal clamps 48 are secured to tranverse platform 40 by inserting threaded bolt or screw 52 through openings in transverse platform 40. In this manner, channels 42 and 44 and openings in leg members 24 and 26 are not required as in the first preferred embodiment.

It should be appreciated that the invention can be practiced by using other suitable fastening devices to attach platform assembly 28 and brackets 34, 36 to the chair. It should also appreciated that the invention can is not limited by the materials used in the invention and that the invention can be formed or constructed in many configurations and from many different materials. For example, the invention can be made from rolled or stamped aluminum grate material or manufactured from plastic or even from wood.

To use the combination chair and hand truck 10 as a load carrier, the chair is folded up into its generally vertical storage or closed position as shown in FIG. 1. This position permits seat 16 to be folded and disposed inwardly between rear legs 14 and 15 providing a cargo-carrying area along carrying frame 12, platform 28, seat 16, and back rest 18 capable of supporting a load which is desired to be carried. The cargo carried by the chair and hand truck 10 may be secured to the carrying frame 12 using elastic cords or the like. The user then pivots the chair about the rear legs 14 and 15 to thereby allow the user to tow the load upon the wheels 30 and 32 like a dolly.

In order to convert the chair and hand truck 10 from a load carrier to a chair, the cargo load is unloaded and the seat 16 is unfolded until it is generally horizontal as illustrated in FIG. 2. Such operation for unfolding the chair will be apparent to those skilled in the art without the need of enumerating the same. The platform assembly 28 can be either removed or left in place to be used as a foot rest.

While this invention has been described in conjunction with specific embodiments, it is evident that many alternatives, modifications and variations will be apparent to those skilled in the art. Accordingly, the preferred embodiments of the invention as set forth herein are intended to be illustrative, rather than limiting. Various changes may be made without departing from the spirit and scope of the invention as defined in the following claims.

What is claimed is:

1. A method of retrofitting a folding chair to form a combination folding chair and hand truck, the method comprising the steps of:

providing a folding chair comprising a pair of upright members held in parallel spaced relation, a seat hingedly attached to the pair of upright members, a generally U-shaped carrying frame pivotably connected to the pair of upright members forming a pair of parallel, spaced-apart leg members and having an upper back rest portion;

removably attaching a wheel assembly to the pair of upright members of said chair, said wheel assembly comprising a plurality of brackets for removably attaching said wheel assembly to the pair of upright members, an axle fixedly attached to the plurality of brackets, and a pair of wheels rotatably connected to opposite ends of the axle; and removably attaching a platform assembly to the pair of leg members, said platform assembly comprising a lift member, a transverse platform and a plurality of elongated right and left channels extending vertically from the lift member, whereby said combination chair and hand truck is used as a chair when said combination chair and hand truck is in an open position, and whereby said combination chair and hand truck is used as a hand truck when said combination chair and hand truck is in a closed position.

2. The method of retrofitting a folding chair according to claim 1, wherein each bracket of the plurality of brackets is generally triangular in shape.

3. The method of retrofitting a folding chair according to claim 1 further comprising attachment means for removably attaching the platform assembly to the pair of leg members.

4. The method of retrofitting a folding chair according to claim 3, wherein said attachment means comprises a plurality of elongated channels attached to the transverse platform of said platform assembly, each channel having an aperture for aligning with an opening in one of the pair of leg members.

5. The method of retrofitting a folding chair according to claim 3, wherein said attachment means comprises at least one metal clamp for receiving the pair of leg members, the at least one metal clamp having an aperture for aligning with an opening in one of the pair of leg members.

6. A combination chair and hand truck, comprising:

a chair comprising a pair of upright members held in parallel spaced relation, a seat hingedly attached to the pair of upright members, a generally U-shaped carrying frame pivotably connected to the pair of upright members forming a pair of parallel, spaced-apart leg members and having an upper back rest portion;

a wheel assembly removably attached to the pair of upright members of said chair, said wheel assembly comprising a plurality of brackets for removably attaching said wheel assembly to the pair of upright members, an axle fixedly attached to the plurality of brackets, and a pair of wheels rotatably connected to opposite ends of the axle; and a platform assembly removably attached to the pair of leg members, said platform assembly comprising a lift member, a transverse platform, and a plurality of elongated right and left channels extending vertically from the lift member, wherein said combination chair and hand truck is used as a chair when said combination chair and hand truck is in an open position, and wherein said combination chair and hand truck is used as a hand truck when said combination chair and hand truck is in a closed position.

7. The combination chair and hand truck according to claim 6, wherein each bracket of the plurality of brackets is generally triangular in shape.

8. A method for retrofitting a wheel assembly and platform assembly to a folding chair, the method comprising the steps of:

providing a folding chair having a pair of leg members;

removably attaching a wheel assembly to the folding chair; and removably attaching a platform assembly to the folding chair, the platform assembly comprising a lift member, a transverse platform and a plurality of elongated right and left channels extending vertically from the lift member, each channel having an aperture, and a bolt for inserting through the aperture and an opening in one of the pair of leg members when the aperture and the opening are in alignment with each other for removably attaching the platform assembly to the pair of leg members of the folding chair, whereby a combination chair and hand truck is formed when the wheel assembly and platform assembly are removably attached to the folding chair.

9. The method according to claim 8, wherein the folding chair comprises a pair of upright members held in parallel spaced relation, a seat hingedly attached to the pair of upright members, a generally U-shaped carrying frame pivotably connected to the pair of upright members forming a pair of parallel, spaced-apart leg members and having an upper back rest portion.

10. The method according to claim 9, wherein the wheel assembly comprises a plurality of brackets for removably attaching said wheel assembly to the pair of upright members, an axle fixedly attached to the plurality of brackets, and a pair of wheels rotatably connected to opposite ends of the axle.

11. A combination chair and hand truck, comprising:

a chair comprising a pair of upright members held in parallel spaced relation, a seat hingedly attached to the pair of upright members, a generally U-shaped carrying frame pivotably connected to the pair of upright members forming a pair of parallel, spaced-apart leg members and having an upper back rest portion;

a wheel assembly removably attached to the pair of upright members of said chair, said wheel assembly comprising a plurality of brackets for removably attaching said wheel assembly to the pair of upright members, an axle fixedly attached to the plurality of brackets, and a pair of wheels rotatably connected to opposite ends of the axle; and a platform assembly removably attached to the pair of leg members, said platform assembly comprising a lift member, a transverse platform, and at least one metal clamp for receiving the pair of leg members, the at least one metal clamp having an aperture, and a bolt for inserting through the aperture and an opening in one of the pair of leg members when the aperture and the opening are in alignment with each other, wherein said combination chair and hand truck is used as a chair when said combination chair and hand truck is in an open position, and wherein said combination chair and hand truck is used as a hand truck when said combination chair and hand truck is in a closed position.

12. The combination chair and hand truck according to claim 11, wherein each bracket of the plurality of brackets is generally triangular in shape.

13. A method for retrofitting a wheel assembly and platform assembly to a folding chair, the method comprising the steps of:

providing a folding chair having a pair of leg members;

removably attaching a wheel assembly to the folding chair; and removably attaching a platform assembly to the folding chair, the platform assembly comprising a lift member, a transverse platform and a plurality of clamps for removably attaching the platform assembly to the pair of leg members of the folding chair, whereby a combination chair and hand truck is formed when the wheel assembly and platform assembly are removably attached to the folding chair.

14. The method according to claim 13, wherein the wheel assembly comprises a plurality of brackets for removably attaching said wheel assembly to the pair of leg members, an axle fixedly attached to the plurality of brackets, and a pair of wheels rotatably connected to opposite ends of the axle.

15. The method according to claim 14, wherein each bracket of the plurality of brackets is generally triangular in shape.

* * * * *